US005190106A

United States Patent [19]

Johnston

[11] Patent Number: 5,190,106

[45] Date of Patent: Mar. 2, 1993

[54] WELL INJECTION VALVE RETRIEVABLE CHOKE

[75] Inventor: Russell A. Johnston, Alvin, Tex.

[73] Assignee: Camco International Inc., Houston, Tex.

[21] Appl. No.: 772,515

[22] Filed: Oct. 7, 1991

[51] Int. Cl.[5] ..... E21B 43/12

[52] U.S. Cl. ..... 166/322; 166/323; 251/94

[58] Field of Search ..... 166/319, 322, 324, 311

[56] References Cited

U.S. PATENT DOCUMENTS

| | | | |
|---|---|---|---|
| 3,981,358 | 9/1976 | Watkins et al. | 166/323 |
| 3,993,129 | 11/1976 | Watkins | 166/319 |
| 4,215,748 | 8/1980 | Pace et al. | 166/322 |
| 4,276,937 | 7/1981 | Calhoun et al. | 166/323 |
| 4,291,722 | 9/1981 | Churchman | 166/323 |
| 4,411,316 | 10/1983 | Carmody | 166/323 |
| 4,585,067 | 4/1986 | Blizzard et al. | 166/323 |
| 4,601,342 | 7/1986 | Pringle | 166/323 |

*Primary Examiner*—Ramon S. Britts
*Assistant Examiner*—Frank S. Tsay
*Attorney, Agent, or Firm*—Fulbright & Jaworski

[57] ABSTRACT

An injection valve for use in a well having a valve closure element positioned below a valve seat moving between an open position to a closed position on the valve seat for blocking off upward flow through the bore, but allowing downward flow. A flow tube is telescopically movable in the housing for controlling the movement of the valve closure member and a piston is movable in the housing and connected to the flow tube and exposed to fluid in the bore. An upwardly facing shoulder on the flow tube receives a retrievable orifice member for providing a force for fully opening the valve when fluid is injected downwardly through the bore. A retrievable lockout sleeve is provided to lock the valve open when the retrievable orifice is removed.

3 Claims, 3 Drawing Sheets

WELL INJECTION VALVE RETRIEVABLE CHOKE

BACKGROUND OF THE INVENTION

It is known to utilize an injection valve in oil and/or gas wells in which fluids are injected down into the well from the well surface for various purposes such as secondary recovery, fluid disposal, or fluid storage. One type of injection valve which has been used is shown in U.S. Pat. No. 4,601,342.

The present invention is directed to an improved injection valve which is less complicated, less expensive and provides a fuller open bore for passage of wireline tools therethrough.

SUMMARY

The present invention is directed to a well injection valve which includes a housing with a bore therethrough, and a downwardly facing seat in the bore. A valve closure element is positioned below the valve seat moving between an open position to a closed position on the valve seat for blocking off upward flow through the bore, but allowing downward flow. A tubular flow tube is telescopically movable in the housing, and is movable downwardly through the valve seat for opening the valve, and is movable upwardly for allowing the valve to close. Biasing means in the housing biases the flow tube upwardly for closing the valve. A piston is movable in the housing and is connected to the flow tube and exposed to fluid in the bore above the valve seat. An upwardly facing shoulder is provided on the flow tube in the bore and a retrievable orifice member is retrievably positioned on the shoulder for providing a force for fully opening the valve when fluid is injected downwardly through the bore.

Yet a still further object of the present invention is wherein the housing includes a downwardly facing shoulder and a lockout sleeve is provided which includes a tubular member telescopically movable into and out of the bore and having a bottom end sized to engage the upwardly facing shoulder on the flow tube when the retrievable orifice is removed. Releasable locking means are provided on the exterior of the tubular member for engaging the downwardly facing shoulder in the housing for locking open the valve.

Other and further objects, features and advantages will be apparent from the following description of a presently preferred embodiment of the invention, given for the purpose of disclosure, and taken in conjunction with the accompanying drawings.

DESCRIPTION OF THE PREFERRED EMBODIMENT

The present injection valve will be described, for purposes of illustration only, as a tubing retrievable type valve using a flapper type closure member. It is to be understood that the present injection valve may be used with other types of closure members and in other type of valves. However, the present valve is particularly useful as a tubing retrievable type valve since it will provide fuller open bore capabilities.

Figure 1A:
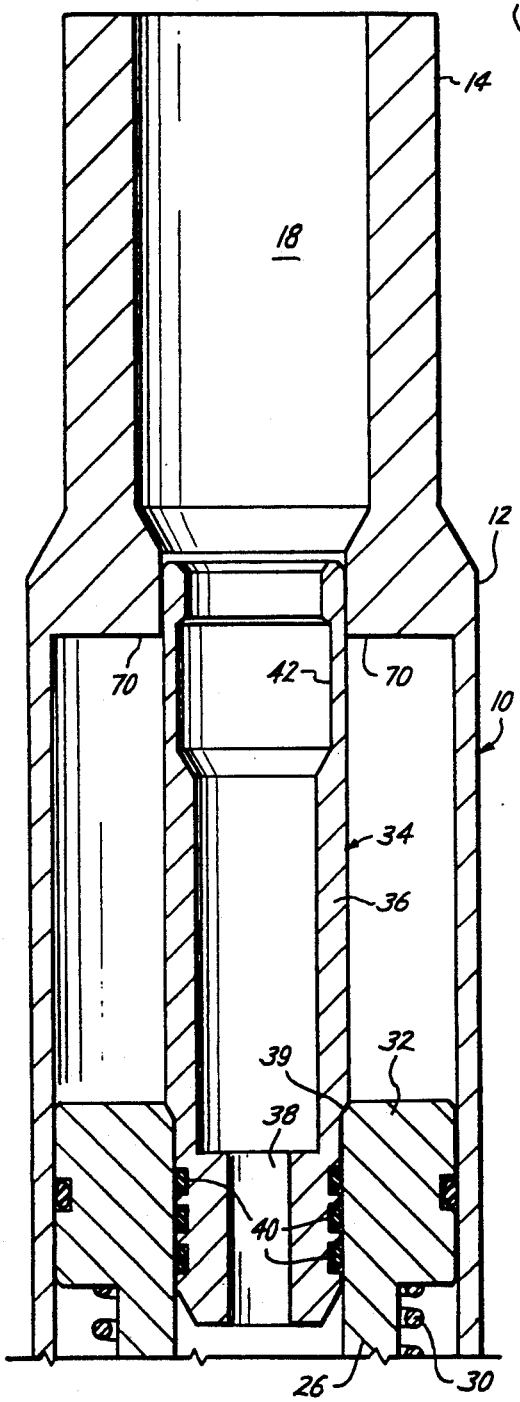
FIGS. 1A, 1B and 1C are continuations of each other and form an elevational view in cross section of the injection valve of the present invention.
Figure 1B:
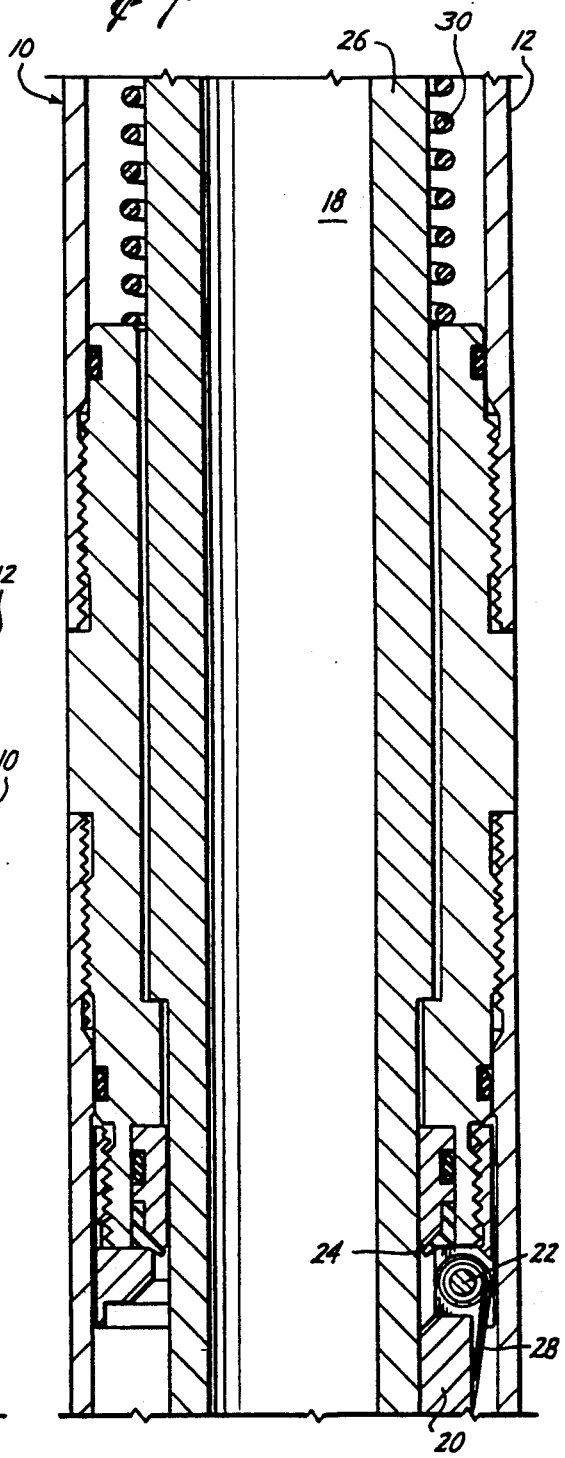
Figure 1C:
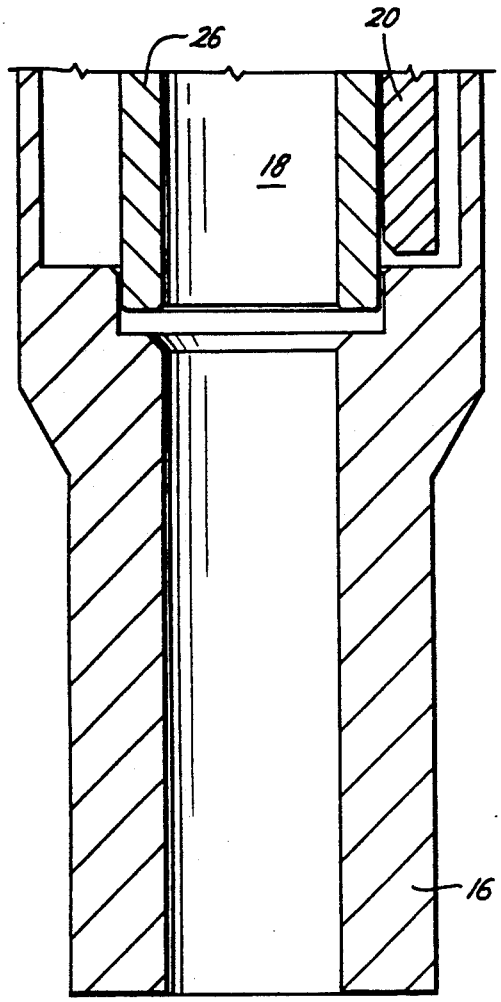

Referring now to the drawings, and particularly to FIGS. 1A-1C, the reference numeral 10 generally indicates the well fluid injection valve of the present invention, and includes a housing 12 having an upper end 14 and a lower end 16, normally provided with connecting means, such as threads (not shown) for connecting the valve 10 in a well tubing string.

The housing 12 includes a bore 18, and includes a valve closure member 20 (FIGS. 1B and 1C) positioned to open and close the bore 18 for allowing downward flow but preventing the upward flow of fluids therethrough. The flapper valve member 20 is connected to a pivot 22 for moving from the open position as best seen in FIGS. 1B and 1C to a closed position seating on a valve seat 24. A flow tube 26 is telescopically movable in the housing 12 and is adapted to move downwardly through the valve seat 24 and open the valve closure member 20. When the flow tube 26 is moved upwardly beyond the seat 24, the flapper valve member 20 will move upwardly and seat on the valve seat 24 by the action of a spring 28. Biasing means, such as a spring 30, is provided for yieldably uring the flow tube 26 upwardly for closing the flapper valve member 20.

A piston 32 (FIG. 1A) is movable in the housing 12 and is connected to the flow tube 26 and exposed to fluid in the bore 18 above the valve seat 24. Thus, when fluid is injected from the well surface downwardly through the valve 12 and through the bore 18, the downwardly flowing fluid acts on the piston 32 to overcome the biasing spring 30 and open the flapper 20. The piston 32 is advantageous in providing a force to overcome the biasing spring 30 and open the valve 10.

However, with a full open bore 18 through the flow tube 26, the force exerted on the piston 32 may not be sufficient to move the bottom end of the flow tube 26 entirely through the flapper 20 and provide the necessary protection from erosion of the flapper 20 as is desired. This is particularly true when the flow rate of the injection fluid downwardly through the bore 18 is low. Therefore, a retrievable orifice 34 is provided having a body 36 and an orifice 38 (FIGS. 1A) which may be sized to provide a sufficient pressure differential across the orifice 38 when fluid is injected down the bore 18 to move the flow tube 26 through the valve seat 24 and to a fully down position as shown (FIG. 1C) to protect the flapper valve 20. The orifice 34 may be installed by dropping it into the well from the well surface where it contacts and seats on an upwardly facing shoulder 39 on the flow tube 26 and the friction of O-rings 40 will hold the orifice 34 in position. The removable orifice 34 includes a recess 42 so that it may be pulled from the valve 10 by a suitable pulling tool such as a type PRS pulling tool of Camco International Inc. Preferably, the size of the orifice 38 is such that depending upon the flow rate of the injection fluids downwardly a nominal 10 psi differential across the orifice 38 is provided.

As has previously been indicated, it is desirable to run wireline tools through the valve 10 to provide various well functions therebelow. In this event, the retrievable orifice 34 is retrieved and removed from the valve 10.

Figure 2A:
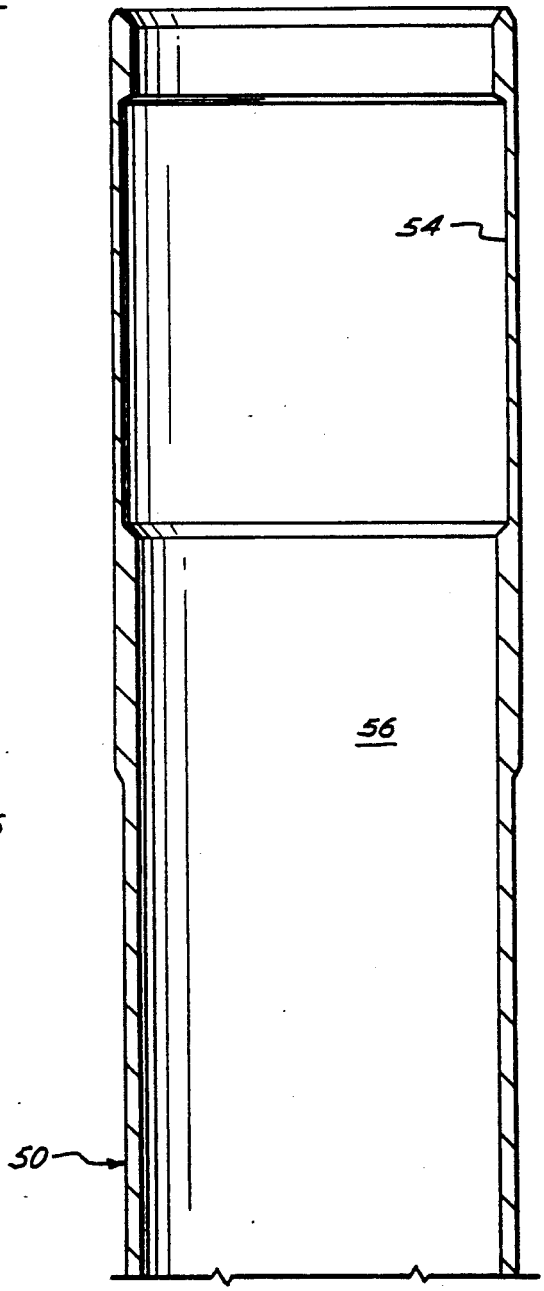
FIGS. 2A and 2B are continuations of each other and form and enlarged elevational view, in cross section, of a lockout sleeve for use in the valve of FIGS. 1A-1C.

In order to run wireline tools through the valve 10, the retrievable orifice 34 is pulled as previously discussed. In its place is inserted a lockout sleeve, generally indicated by the reference numeral 50 (FIGS. 2A and 2B), shown in double scale as compared to the valve 10. The sleeve 50 is a tubular member having a bottom end 52 sized to engage the upwardly facing shoulder 39 on the flow tube 26 when the retrievable orifice 34 is removed. The sleeve 50 includes a recess 54 for engagement by a setting and/or retrieving tool for inserting the sleeve 50 into the bore 18 of the housing 12 of the valve 10, and retrieving it therefrom. In installation, the bottom end 52 of the sleeve 50 engages the shoulder 39 on the flow tube 26 and as the sleeve 50 is moved downwardly the flow tube is pushed downwardly through the valve seat 24 and opens the flapper valve 20 and protects the flapper valve 20. The sleeve 50 includes an open bore 56 therethrough for providing an increased cross-sectional area for wireline tools as compared to prior art injection valves. The bore 56 is substantially the same size as the bore of the flow tube 26.

Figure 2B:
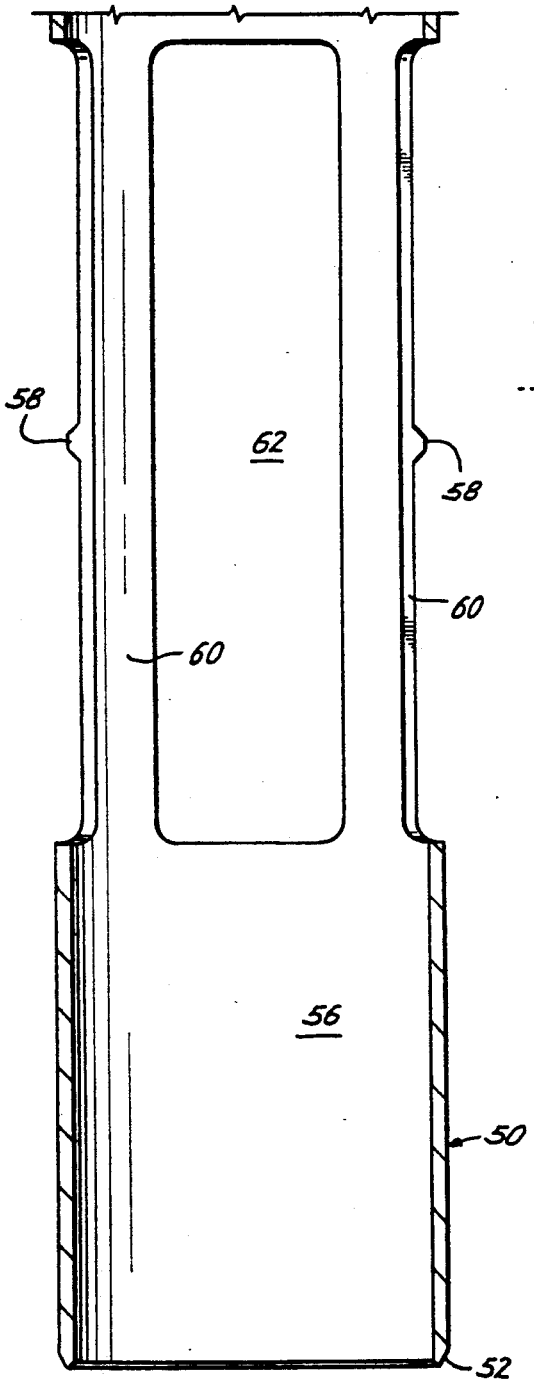
Figure 3:
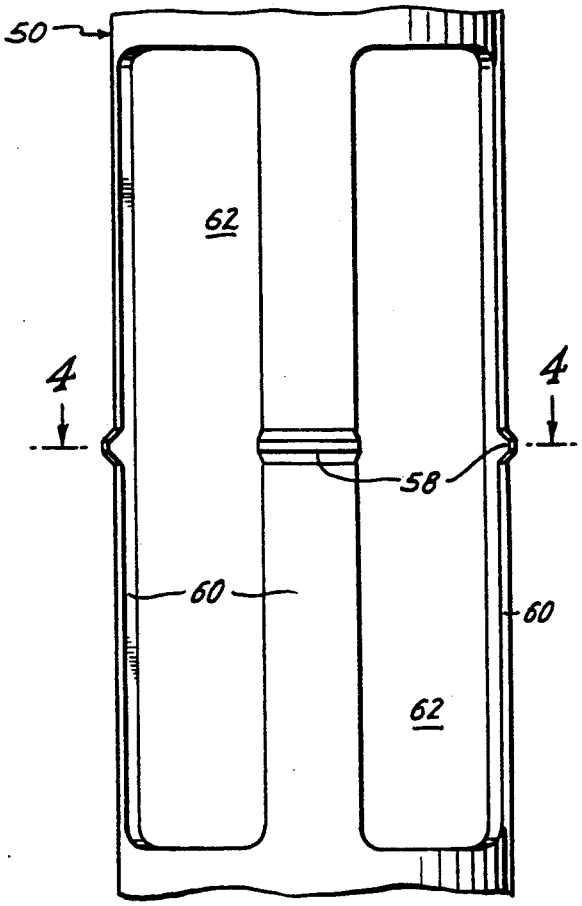
FIG. 3 is an enlarged fragmentary elevational view of a portion of the apparatus of FIG. 2B.
Figure 4:
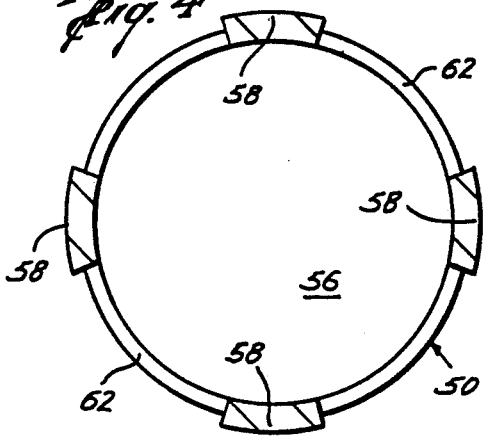
FIG. 4 is a cross-sectional view, taken along the line 4—4 of FIG. 3.

The lockout sleeve 50 also includes releasable locking means such as collets 58 (FIGS. 2B, 3 and 4). The collets 58 are formed on fingers 60 which will flex inwardly and outwardly due to an opening 62 between adjacent fingers 60. The collets 58 engage a downwardly facing shoulder 70 (FIG. 1A) in the housing 12 when the flow tube 26 is in its full downward position and the valve is open. The engagement of the collets 58 with the shoulder 70 releasably locks the valve 10 in the open position.

After use of any desired wireline tools, the lockout sleeve 50 may be retrieved from the bore 18 of the valve 10 and regular injection procedures resumed. Of course, the lockout sleeve 50 may remain in place as long as needed.

The present invention, therefore, is well adapted to carry out the objects and attain the ends and advantages mentioned as well as others inherent therein. While a presently preferred embodiment of the invention has been given for the purpose of disclosure, numerous changes in the details of construction and arrangement of parts may be made without departing from the spirit of the invention, and the scope of the appended claims.

What is claimed is:

1. A well fluid injection valve comprising, a housing with a bore therethrough, a downwardly facing valve seat in the bore, a valve closure element positioned below the valve seat moving between an open position to a closed position on the valve seat for blocking off upward flow through the bore but allowing downward flow, a tubular flow tube telescopically movable in the housing, and movable downwardly through the valve seat for opening the valve and movable upwardly for allowing the valve to close, biasing means in the housing for biasing the flow tube upwardly for closing the valve, a piston movable in the housing and connected to the flow tube and exposed to fluid in the bore, an upwardly facing shoulder on the flow tube in the bore, and a retrievable orifice member retrievably positioned on the shoulder for providing a force for opening the valve when fluid is injected downwardly through the bore.

2. The valve of claim 1 wherein the housing includes a downwardly facing shoulder and including a lockout sleeve comprising, a tubular member telescopically movable into and out of the bore and having a bottom end sized to engage the upwardly facing shoulder when the retrievable orifice is removed, and releasable locking means on the exterior of the tubular member for engaging the downwardly facing shoulder for locking open the valve.

3. The valve of claim 2 wherein the bore of the lockout sleeve is substantially the same cross-sectional area as the bore of the flow tube.

* * * * *

UNITED STATES PATENT AND TRADEMARK OFFICE

CERTIFICATE OF CORRECTION

PATENT NO. : 5,190,106

DATED : March 2, 1993

INVENTOR(S) : Russell A. Johnston

It is certified that error appears in the above-indentified patent and that said Letters Patent is hereby corrected as shown below:

On title page, item [54], line 1, and col. 1, line 1, after "VALVE", insert --WITH--

Col. 2, line 29, delete "uring" and insert --urging--

Signed and Sealed this

Eighteenth Day of January, 1994

*Attest:*

*Attesting Officer*

Bruce Lehman

BRUCE LEHMAN

*Commissioner of Patents and Trademarks*